US008080136B2

(12) United States Patent
Enqvist et al.

(10) Patent No.: US 8,080,136 B2
(45) Date of Patent: Dec. 20, 2011

(54) DRYING WIRE

(75) Inventors: Rauno Enqvist, Nokia (FI); Marja Ojanen, Pirkkala (FI)

(73) Assignee: Metso Fabrics Oy, Tampere (FI)

( * ) Notice: Subject to any disclaimer, the term of this patent is extended or adjusted under 35 U.S.C. 154(b) by 502 days.

(21) Appl. No.: 12/296,800

(22) PCT Filed: Apr. 24, 2007

(86) PCT No.: PCT/FI2007/050219

§ 371 (c)(1),
(2), (4) Date: Oct. 22, 2008

(87) PCT Pub. No.: WO2007/125165

PCT Pub. Date: Nov. 8, 2007

(65) Prior Publication Data

US 2009/0159148 A1 Jun. 25, 2009

(30) Foreign Application Priority Data

Apr. 27, 2006 (FI) ..... 20065274

(51) Int. Cl.
*D21F 7/12* (2006.01)
*D21F 1/10* (2006.01)

(52) U.S. Cl. ..... 162/348; 162/375; 162/902; 162/903; 139/383 A; 34/95; 442/243

(58) Field of Classification Search ..... 162/348, 162/902, 903, 358.2, 361, 362, 375, 376; 34/95; 442/208, 209, 213, 214, 243; 139/383 A, 139/425 A See application file for complete search history.

(56) References Cited

U.S. PATENT DOCUMENTS

| | | | | |
|---|---|---|---|---|
| 4,141,388 | A | 2/1979 | Romanski et al. | |
| 4,261,392 | A | 4/1981 | Westhead | |
| 4,274,448 | A | 6/1981 | Westhead | |
| 5,732,749 | A | 3/1998 | Fargeout | |
| 5,945,357 | A * | 8/1999 | Quigley | 442/189 |
| 6,207,598 | B1 * | 3/2001 | Lee et al. | 442/206 |

FOREIGN PATENT DOCUMENTS

| | | | |
|---|---|---|---|
| WO | WO 93/17180 A2 | | 9/1993 |
| WO | WO 2006/013232 | * | 2/2006 |
| WO | WO 2006/013232 A1 | | 2/2006 |

* cited by examiner

*Primary Examiner* — Eric Hug
(74) *Attorney, Agent, or Firm* — Oliff & Berridge, PLC

(57) ABSTRACT

A drying wire provided with an independent top fabric and bottom fabric. The bottom fabric is woven from longitudinal and cross direction monofilament yarns. The top fabric is woven from longitudinal yarns and shapeable cross direction yarns. The shapeable yarns make the structure of the top fabric denser and increase the contact surface area and the number of contact points. On the other hand, the bottom fabric is also smooth, wherefore it has good aerodynamic properties.

10 Claims, 2 Drawing Sheets

DRYING WIRE

BACKGROUND OF THE INVENTION

Figure 1:
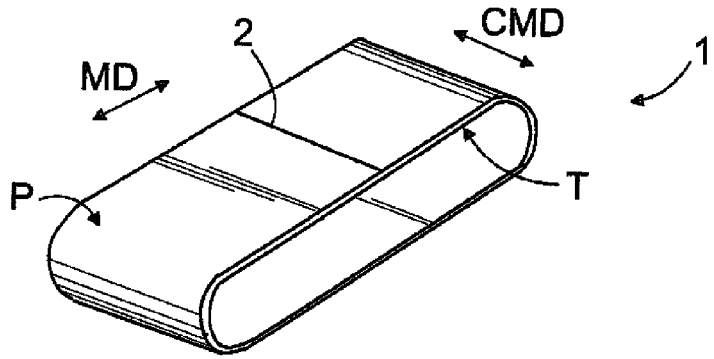

The invention relates to a drying wire which comprises a roll side surface and a surface on the side of a paper web to be dried; and which has been woven from a plurality of machine direction longitudinal yarns and a plurality of cross direction transverse yarns; and which drying wire has at least a top fabric and a bottom fabric on top of one another, the top fabric being on the paper side and the bottom fabric on the roll side; wherein the top fabric and the bottom fabric are independent fabric layers comprising their own longitudinal yarns and cross direction yarns; and wherein the top fabric and the bottom fabric are woven simultaneously in a weaving machine and fastened to one another by a plurality of binding yarns.

A dryer section of a paper machine employs drying wires, by which a paper web to be dried is guided through the dryer section. The drying wire is formed from yarns that sustain high temperatures and moisture using suitable weave structures so that the drying wire has a certain permeability. One problem of known drying wires is that they have inadequate aerodynamic properties and an insufficient surface smoothness. Also, the basic structure of many drying wires is instable, which impairs the runnability in the paper machine.

BRIEF DESCRIPTION OF THE INVENTION

It is an object of the present invention to provide a new and improved drying wire.

The drying wire of the invention is characterized in that the bottom fabric only comprises monofilament yarns; and that at least some of the cross direction yarns of the top fabric are shapeable yarns extending on the paper side of the top fabric substantially to the same level with the longitudinal yarns of the top fabric, thus forming contact points and a contact surface on the paper side.

The idea of the invention is that the drying wire comprises at least two independent fabric layers arranged on top of one another, i.e. a top fabric and a bottom fabric. The bottom fabric is woven from longitudinal and cross direction monofilament yarns. The top fabric is woven from longitudinal and cross direction yarns. At least some of the cross direction yarns of the top fabric are shapeable yarns.

The invention provides the advantage that the bottom fabric consisting of monofilament yarns is able to tolerate mechanical stress and has a structure that is stable both in terms of dimensions and shape. Such a fabric is stable and has a good runnability. In addition, the monofilament structure carries a small amount of air with it, and thus the bottom fabric may have good aerodynamic properties. The top fabric, for its part, may be relatively dense due to the shapeable yarns. Furthermore, the cross direction yarns of the top fabric may be shaped between the machine direction yarns, in which case they may run at the level of the machine direction yarns on the paper side surface, which means that the shapeable cross direction yarns fill the holes in the surface on the web side of the wire. Thus, the top fabric may have a large contact surface area and, on the other hand, a plurality of contact points, whereby heat is transferred efficiently from the wire to the web and the drying is efficient. Furthermore, the large contact surface area and a great number of contact points contribute to the formation of adhesion forces between the drying wire and the web to be dried, thus improving the runnability.

Another advantage is that the drying wire of the invention may have the desired properties immediately after the weaving. Thus, the surfaces of the wire fabric layers need not necessarily be ground, calendered or exposed to an efficient shrinking treatment after the weaving. The manufacture of the drying wire may thus be faster and the manufacturing costs smaller.

The idea of an embodiment of the invention is that substantially all cross direction yarns of the top fabric are shapeable yarns. Such a top fabric has a particularly large contact surface area and, on the other hand, a particularly large number of contact points.

The idea of an embodiment of the invention is that the shapeable cross direction yarns of the top fabric are soft yarns. By using such yarns, a fabric layer with a soft surface, lots of contact points and a large contact surface area may be formed. The fabric layer may also be dense.

The idea of an embodiment of the invention is that the cross direction soft yarns of the top fabric are multifilament yarns or spun yarns.

The idea of an embodiment of the invention is that the shapeable yarns are yarns to be shaped by heat or weaving forces. Alternatively the shapeable yarns may be yarns to be shaped at a fabric's post-treatment stage after the weaving or shaped in an application by means of moisture, heat and forces applied during the use. Such shapeable yarns may have a structure of monofilament yarns, multifilament yarns, bicomponent yarns or hollow yarns, for example.

The idea of an embodiment of the invention is that the top fabric comprises both soft yarns and yarns to be shaped mechanically or by heat.

The idea of an embodiment of the invention is that between the top fabric and the bottom fabric there are several cross direction filling yarns, which make the structure of the drying wire denser. Furthermore, the filling yarns may increase the cross direction stiffness of the drying wire and may thus make the wire more stable.

The idea of an embodiment of the invention is that the longitudinal yarns of the bottom fabric have a flat, e.g. oval or rectangular, cross-section. Flat yarns are known to be stiff in one direction and very flexible in the other direction. Thus, a fabric layer woven from flat yarns is very stable, when viewed in the direction of the fabric level. Flat yarns support the fabric structure in the direction of its surface. In addition, when flat yarns are used, the roll side surface may be smoother than when round yarns are used, in which case the wire transports less air in it. The wire thus has good aerodynamic properties and a good runnability in the paper machine.

The idea of an embodiment of the invention is that the longitudinal yarns of the top fabric have a flat, e.g. oval or rectangular, cross-section. Flat yarns are known to be stiff in one direction and very flexible in the other direction. Thus, a fabric layer woven from flat yarns is very stable, when viewed in the direction of the fabric level. Flat yarns support the fabric structure in the direction of its surface. In addition, when flat yarns are used, the surface on the side of the web to be dried may be smoother than when round yarns are used.

The idea of an embodiment of the invention is that the top fabric and the bottom fabric are single-layer structures, which have cross direction yarns in one layer, and that the top layer and the bottom layer have a two-shed structure. In this case, on the surface of the paper side of the drying wire, the machine direction yarns and the shapeable cross direction yarns constitute substantially an equal number of contact points.

The idea of an embodiment of the invention is that the top fabric of the drying wire is hydrophilic and smooth, wherefore the web to be dried remains well in its place on the wire surface and the runnability of the wire in the paper machine is good. Yarns made of a hydrophilic material or yarns treated with a hydrophilic material may be used in the surface layer. On the other hand, the top fabric may be treated with such a material after the weaving.

BRIEF DESCRIPTION OF THE INVENTION

Figure 2:
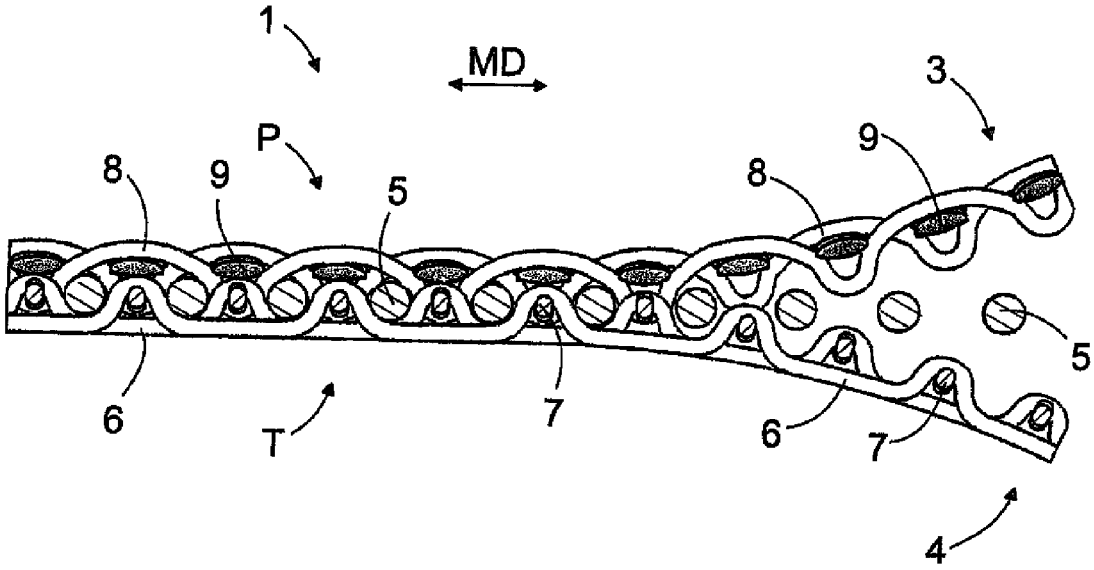
Figure 3:
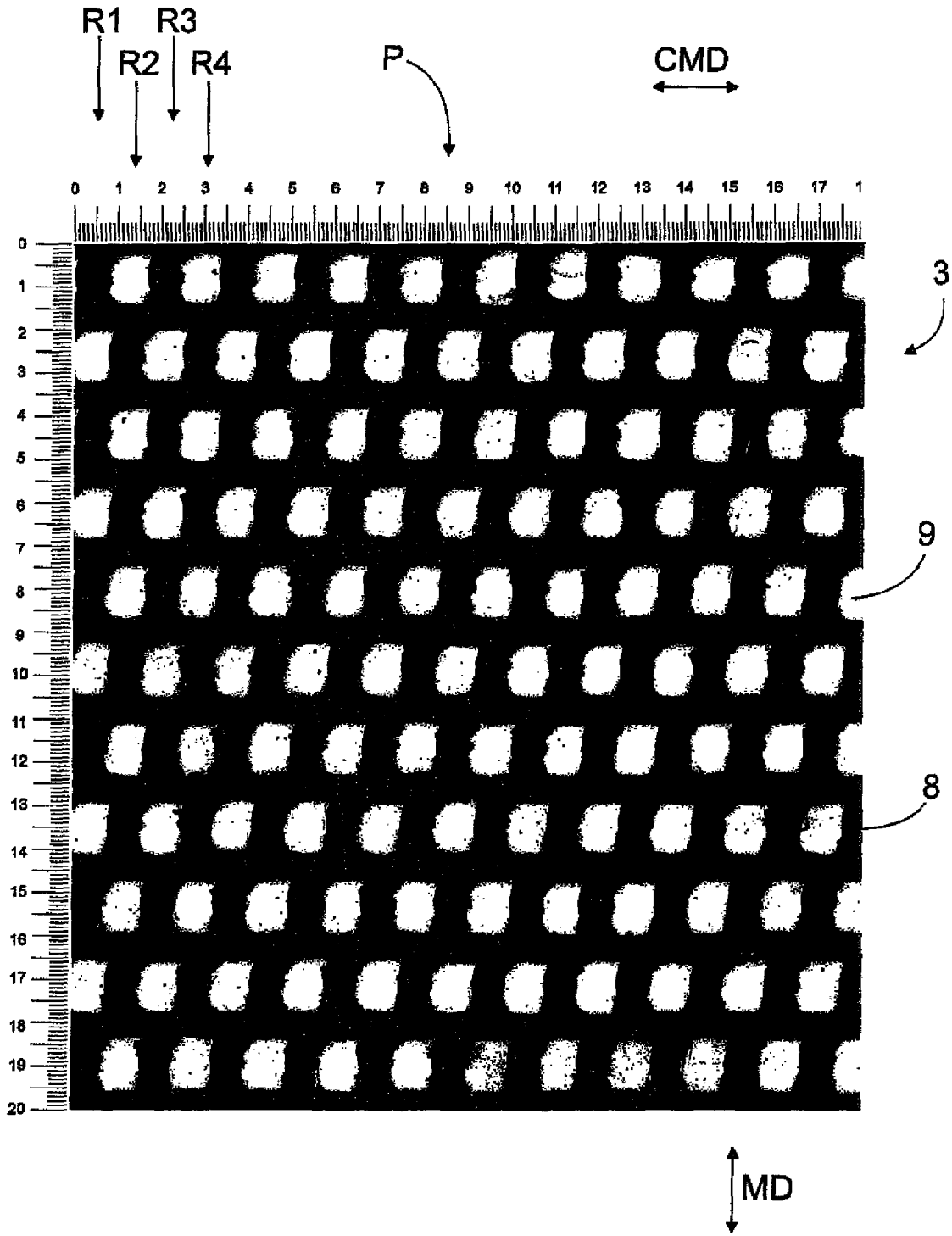

The invention will be explained in greater detail in the attached drawings, in which FIG. 1 schematically and perspectively shows a drying wire, which may be run in a closed loop on a drying section of a paper machine, FIG. 2 schematically shows a drying wire of the invention in the cross direction CMD of the paper machine, and FIG. 3 schematically shows a picture taken by a microscope, illustrating the top fabric of the drying wire of the invention.

For the sake of clarity, some embodiments of the invention are simplified in the figures. Like parts are denoted in the figures by like reference numerals.

DETAILED DESCRIPTION OF SOME EMBODIMENTS OF THE INVENTION

FIG. 1 shows a strong simplification of a drying wire 1, which may be run in the machine direction MD and which has a cross machine direction CMD width. The drying wire 1 may be manufactured in a closed loop in a weaving machine. Alternatively the drying wire 1 may comprise one or more seams 2, in which case it may be connected as a closed loop on a drying section of the paper machine.

FIG. 2 shows a drying wire 1 of the invention in the cross machine direction CMD. The drying wire 1 comprises a paper-side surface P, against which the paper web to be dried may be arranged on the drying section. Furthermore, on the opposite side of the drying wire 1 there is a roll side surface T, which may be supported against the paper machine rolls. The drying wire 1 may comprise at least two fabrics on top of one another, i.e. a top fabric 3 on the paper side P and a bottom fabric 4 on the roll side T. The top fabric 3 and the bottom fabric 4 may be formed by weaving in the weaving machine, and both of them may comprise their own yarn systems, i.e. longitudinal MD yarns and cross-direction CMD yarns. The top fabric 3 and the bottom fabric 4 may be woven simultaneously in the same weaving machine, and the fabrics 3, 4 may be connected to one another by means of one or more yarns. For the sake of clarity, in FIG. 2 the fabric layers 3, 4 are separated from one another in the right-hand section of the wire. The drying wire 1 may be woven in such a manner that the yarns in the longitudinal direction MD are warp yarns and the yarns in the cross direction CMD are weft yarns. Between the fabric layers 3, 4 there may be a plurality of cross direction filling yarns 5, which make the structure of the drying wire 1 denser. The cross-section of the filling yarns 5 may be round, or in some cases flat yarns may be used. The filling yarns 5 may be arranged during the weaving in such a manner that they do not cross with the yarns of the top fabric 3 and the bottom fabric 4 at all.

The bottom fabric 4 may be woven from a plurality of longitudinal MD yarns 6 and a plurality of cross direction CMD yarns 7. The yarns 6, 7 of the bottom fabric 4 may be monofilament yarns, which sustain wear and mechanical stress. The bottom fabric 4 may be woven into a firm and stable structure, which improves the runnability of the drying wire 1 on the drying section. The surface of the monofilament yarn is smooth, and thus the bottom fabric 4 may carry a small amount of air in it. In addition, the bottom fabric 4 woven from the monofilament yarns may be cleaned easily, which makes the service life of the drying wire 1 long. Furthermore, the longitudinal yarns 6 of the bottom fabric 4 may be flat in cross-section, e.g. oval, rectangular or rectangular with rounded corners. Flat yarns make the surface of the bottom fabric 4 particularly smooth, and thus it has good aerodynamic properties. The cross-section of the cross direction yarns 7 of the bottom fabric 4 may be round. The bottom fabric 4 is relatively dense in terms of permeability, and its structure is stable. The bottom fabric 4 may be a single-layer structure with cross direction yarns 7 in one layer. It is, however, possible to form a double- or multilayer bottom fabric 4 with cross direction yarns 7 in two or more layers. The bottom fabric 4 shown in FIG. 2 has a two-shed structure, which means that a longitudinal yarn 6 alternately runs over and under a cross direction yarn 7. Alternatively the bottom fabric 4 may have a three-, four-, five- or multi-shed structure, if required.

The top fabric 3 of the drying wire 1 may be woven from a plurality of longitudinal MD yarns 8 and a plurality of cross direction CMD yarns 9. The longitudinal yarns 8 may be monofilament yarns which are flat in cross section, e.g. oval, rectangular or rectangular with rounded corners. The cross direction yarns 9 may be, for instance, multifilament yarns, staple fibre yarn, spun yarn, bicomponent yarn, hollow yarn, or some other "soft" yarn, which may make the structure of the top fabric 3 dense. On the other hand, the shapeable yarn may be shaped by means of heat or weaving forces, in which case it may also be, in addition to the previously mentioned soft yarn structures, a monofilament. The top fabric 3 may be a two-shed structure, which means that the longitudinal yarn 8 may run alternately over and under a cross direction yarn 9. Alternatively, the top fabric 3 may have a three-, four-, five- or multi-shed structure, if required. The top fabric 3 may be a single-layer structure, in which there are shapeable cross direction yarns 9 in one layer. It is also feasible, however, to provide a double- or multilayer top fabric 3 with cross direction yarns 9 in two or more layers. In this case, at least one top fabric 3 layer comprises shapeable cross direction yarns 9, which make the structure denser. Due to shapeability, the cross direction yarns 9 may fill holes between the machine direction yarns 8 on the paper side P, as can be clearly seen later in FIG. 3. It is to be mentioned that instead of the flat cross section shown in FIG. 2, the cross direction yarns may in some cases be round.

The bottom fabric 4 and the top fabric 3 may be connected to one another by means of a plurality of longitudinal yarns 8 of the top fabric 3, which may be arranged to run via the cross direction yarns 7 of the bottom fabric 4. In this case, the longitudinal yarn 8 acts simultaneously as a binding yarn. All yarns 8 or some of the yarns 8 may participate in the binding. It is also possible to arrange the fastening between the fabrics 3 and 4 by means of the longitudinal yarns 6 of the bottom fabric 4 or by means of some of the longitudinal yarns 6. Furthermore, cross direction yarns, such as the cross direction yarns 7 of the bottom fabric 4, may be used for binding. The fabric layers may thus be bound by means of binding wefts or binding warps, and the yarns participating in the binding may further belong to yarn systems of the fabric layers or they may be separate yarn systems.

The fabric layers 3 and 4 or the yarns 5 to 9 used therein may be treated with a substance which improves the cleaning, such as polytetrafluoroethylene (PTFE). The top fabric 3 or the yarns used therein may further be treated with a hydrophobic or hydrophilic material, if necessary.

At least the following yarn materials may be used in the drying wire 1: polyester (PES), polyamide (PA), polyphenylene sulphide (PPS), polyetheretherketone (PEEK), polyethylene terephalate (PET), polymethyl cyclohexylene terephalate (PCTA), polyurethane (PU) and polyethylene naphthalate (PEN).

Example 1

A drying wire was woven, comprising two fabrics on top of one another connected to one another during the weaving, the fabrics being a top fabric and a bottom fabric, which are bound to one another by cross direction yarns of the bottom fabric during the weaving. The following yarns were used in the weaving:

- the top fabric had one layer and a two-shed structure
- the bottom fabric had one layer and a two-shed structure
- the warp yarn of the top and bottom fabrics was a flat monofilament yarn, the dimensions of which were 0.3*0.6 mm
- the weft of the bottom fabric was a monofilament yarn, the diameter of which was 0.4 mm
- the weft of the top fabric was 440 tex, 100 twists
- the filling weft between the top fabric and the bottom fabric was a monofilament yarn, the diameter of which was 0.6 mm
- the warp density was 240/10 cm
- the weft density was 162/10 cm (3*56 wefts)
- the air permeability of the drying wire was 1600 $m^3/m^2$ h, 100 Pa
- the drying wire thickness was 1.5 mm.

FIG. 3 shows a microscopic view of the paper side P of the top fabric 3 of the drying wire according to the above example 1. By means of the figure, it is possible to measure the width of the shapeable cross direction yarns 9, in this case weft yarns, the width of the section between the warp yarns, and to calculate the number of contact points. In a conventional drying wire, the cross direction yarns 9 do not extend to the surface of the paper side P, and thus in the conventional drying wire, white regions in FIG. 3 are holes, which do not constitute a contact surface or contact points. Instead, the drying wire according to the invention comprises shapeable cross direction yarns 9, which may run at the level of machine direction yarns 8 on the surface of the paper side P and thus fill the holes between the machine direction yarns 8. In this case, the drying wire may have twice as many contact points as the corresponding conventional drying wire, in which the yarn run of the cross direction yarn 9 does not extend to the level of the machine direction yarns 8 on the surface of the paper side P. To illustrate the calculation of the contact points, FIG. 3 also shows machine direction rows R1 to R4. For example, when the row R1 is examined from the top to the bottom, the first contact point in the figure is formed by a machine direction yarn 8 coloured black, the second contact point is formed by a shapeable cross direction yarn 9 coloured white, the third contact point is again formed by a machine direction yarn 8 coloured black, etc. The row R1 shown in FIG. 3 thus comprises six black contact points formed by the machine direction yarns 8 and five white contact points formed by the cross direction yarns 9, which makes 11 contact points altogether. The row 2 comprises five black contact points formed by the machine direction yarns 8 and six white contact points formed by the cross direction yarns 9, i.e. 11 contact points altogether. The row 3 corresponds to the row 1 and the row 4 corresponds to the row 2. Since the cross direction yarns 9 coloured white in the figure form contact points on the surface of the paper side P, the total number of contact points in the weave of FIG. 3 may be double the number of contact points formed by the machine direction yarns 8. The drying wire of the example 1 comprises approximately 70 $1/cm^2$ contact points.

On the basis of the dimensions and density of yarns, the number of contact points may vary between 50 and 90 $1/cm^2$. Conventional drying wires have less than 50 $1/cm^2$ contact points, which is essentially less than in the solution according to the invention.

In the drying wire according to the example 1, the contact surface area is about 25% larger than in a similar wire, the cross direction yarns of which are not shapeable yarns extending to the level of the machine direction yarns on the surface of the paper side.

The drawings and the related description are only intended to illustrate the idea of the invention. In its details, the invention may vary within the scope of the claims.

The invention claimed is:

1. A drying wire comprising:

a roll side surface and a surface on a side of a paper web to be dried;

a plurality of machine direction longitudinal yarns and a plurality of cross direction transverse yarns that are woven together;

a double fabric structure comprising a top fabric and a bottom fabric on top of one another, the top fabric being on the paper web side and the bottom fabric on the roll side;

the top fabric and the bottom fabric are independent fabric layers comprising their own longitudinal yarns and cross direction yarns;

the bottom fabric is a single-layer structure;

the top fabric and the bottom fabric are woven simultaneously in a weaving machine and fastened to one another by a plurality of binding yarns;

the bottom fabric only comprises monofilament yarns;

the longitudinal yarns of the top fabric are monofilament yarns; and at least some of the cross direction yarns of the top fabric are heat shapeable yarns extending on the paper side of the top fabric substantially to a same level with the longitudinal yarns of the top fabric, thus forming contact points and a contact surface on the paper side.

2. A drying wire as claimed in claim 1, wherein substantially all cross direction yarns of the top fabric are shapeable yarns.

3. A drying wire as claimed in claim 1, wherein between the top fabric and the bottom fabric there are several cross direction filling yarns that make the structure of the drying wire denser and increase the cross direction stiffness of the drying wire.

4. A drying wire as claimed in claim 1 between the top fabric and the bottom fabric there are several cross direction filing yarns that make the structure of the drying wire denser and increase the cross direction stiffness of the drying wire, and the filling yarns are arranged in the drying wire in such a manner that they do not cross with the yarns of the top fabric and the bottom fabric.

5. A drying wire as claimed in claim 1, wherein the longitudinal yarns of the bottom fabric have a flat cross-section.

6. A drying wire as claimed in claim 1, wherein the longitudinal yarns of the top fabric have a flat cross-section.

7. A drying wire as claimed in claim 1, wherein the top fabric and the bottom fabric have a two-shed structure.

8. A drying wire as claimed in claim 1, wherein the top fabric is a single-layer structure that has cross direction yarns in one layer.

9. A method of using the drying wire as claimed in claim 1 comprising:

driving the drying wire in a drying section of a paper machine; and arranging the roll side surface against the paper machine and the surface on the paper web side against the paper web.

10. A drying wire comprising:

a roll side surface and a surface on a side of a paper web to be dried;

a plurality of machine direction longitudinal yarns and a plurality of cross direction transverse yarns that are woven together;

a double fabric structure comprising a top fabric and a bottom fabric on top of one another, the top fabric being on the paper web side and the bottom fabric on the roll side;

the top fabric and the bottom fabric are independent fabric layers comprising their own longitudinal yarns and cross direction yarns;

the bottom fabric is a single-layer structure;

the top fabric and the bottom fabric are woven simultaneously in a weaving machine and fastened to one another by a plurality of binding yarns;

the bottom fabric only comprises monofilament yarns;

the longitudinal yarns of the top fabric are monofilament yarns; and at least some of the cross direction yarns of the top fabric are heat shapeable yarns extending on the paper side of the top fabric substantially to a same level with the longitudinal yarns of the top fabric, thus forming contact points and a contact surface on the paper side, wherein the heat shapeable yarns are treated with a substance that improves cleaning of the drying wire.

* * * * *